United States Patent [19]

Dreyer

[11] 4,290,365

[45] Sep. 22, 1981

[54] SHOTSHELLS

[76] Inventor: Andre'T. Dreyer, P.O. Box 165, Clocolan, South Africa, 9735

[21] Appl. No.: 7,250

[22] Filed: Jan. 29, 1979

[30] Foreign Application Priority Data

Feb. 3, 1978 [ZA] South Africa ..... 78/0670

[51] Int. Cl.[3] ..... F42B 7/00

[52] U.S. Cl. ..... 102/449; 102/464; 102/532

[58] Field of Search ..... 102/95, 42 R, 42 C, 102/43 R, 43 C

[56] References Cited

U.S. PATENT DOCUMENTS

| | | | |
|---|---|---|---|
| 2,144,232 | 1/1939 | Spengler | 102/95 X |
| 2,772,634 | 12/1956 | Oberfell | 102/42 R |
| 3,221,658 | 12/1965 | Devaux | 102/95 |
| 3,721,197 | 3/1973 | Hughes | 102/42 C |

*Primary Examiner*—Harold J. Tudor

*Attorney, Agent, or Firm*—Prutzman, Kalb, Chilton & Alix

[57] ABSTRACT

The present invention provides a shotshell including a cartridge case having a metal sidewall defining an open end of the case. A charge is contained in the case and retained by an overshot plug which is a friction fit in the case. The sidewall has a thickness of not less than 0.5 mm and may have a formation for engaging a formation on the plug to locate the plug in position.

Shotshell components can be provided as a kit which may include two identical plugs each having a closed air bleed hole which can be extended to pass through the plug. A plug with a completed hole can be used as an overpowder plug while the overshot plug can be used with the hole closed.

11 Claims, 7 Drawing Figures

FIG. 5a
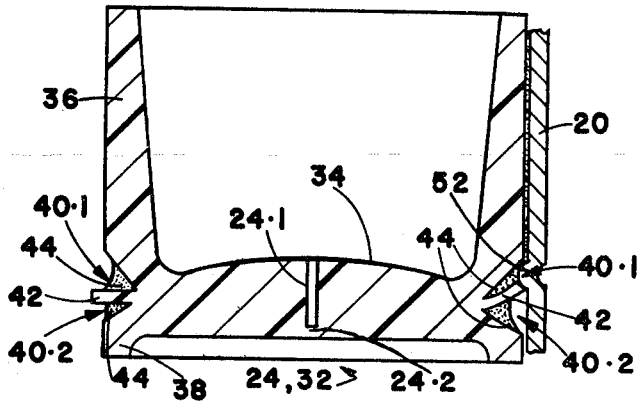
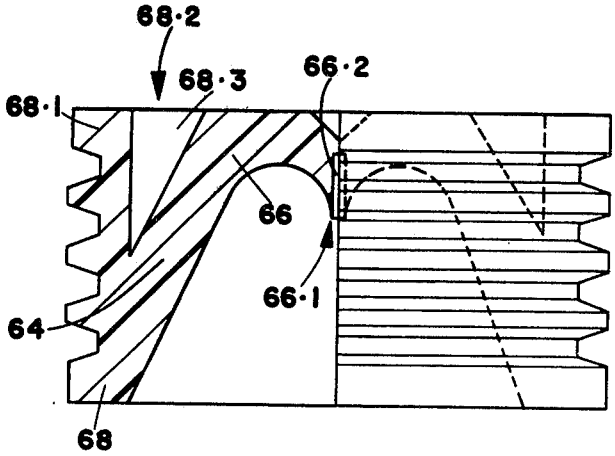
FIG. 5b

SHOTSHELLS

This invention relates to shotshells or gunshot cartridges. It also relates to a method of loading a shotshell and to shotshell component parts for use in forming part of such shotshell.

Prior shotshells best known to the applicant comprise a cartridge case having a brass base with a paper or plastics side. When loading such a shotshell it is charged with certain amounts of propellant, gunshot, and a filler wad or wads, and its open end then closed by star-crimping. A disadvantage of the above method of loading is that the height to which the cartridge is charged before it is crimped is critical. If the height is not correct, then the crimp will either unfold again or it will collapse. Moreover, the tightness of the crimp, which depends on the height to which the cartridge is charged, affects the shot pattern, i.e. the rate and evenness at which the gunshot pellets spread after having left the shotgun barrel.

Another disadvantage of the above method of loading is that crimping severely deforms the side of the cartridge. After repeated reloading the side usually splits, making the cartridge unsuitable for reuse. Thus, in the case of paper cartridges, at most a couple of reloads are possible, whereas in the case of plastics cartridges no more than about 15 to 20 reloads are possible.

Yet another disadvantage of the above method of loading is that the crimp requires the cartridge chamber of a shotgun from which it is to be fired to be smooth in the region in which the front end of the cartridge will be located during firing and also for some distance in front of it. This is necessary to permit the crimped part of the cartridge case to unfold completely and to prevent damage being done to it during firing. Accordingly, it is necessary to provide the base of the cartridge with an outwardly protruding locating rim for locating the shotshell in the cartridge chamber. In the case of an automatic shotgun, this would require a mechanism for automatic ejection and chambering of shotshells which differs from that of conventional automatic rifles. The bullet cartridges of conventional automatic rifles have long ago been modernized by removing their ejector rims and replacing them with ejector grooves.

The applicant is also aware of shotshells with thin plastics sidewalls which can receive plugs to hold a charge in place. The plugs can be thin discs which are invertable to snap-fit in the shot-shell, engaging in an inner groove in the sidewall. However, this groove considerably reduces the sidewall strength and reduces the life of the cartridge case. The plugs can alternatively have detent outer surfaces which can scratch and embed in the plastics sidewall. This also reduces cartridge life. Thirdly, the plugs may be thin resilient discs which fit in the case to retain the charge. These plugs are however, not totally satisfactory for use where the shot-shell is likely to be subjected to shaking or recoil.

In each of these shot-shells, the life of the sidewall, and thus of the case, is relatively limited. The plugs cannot always be used for different size charges or be used satisfactorily as both overpowder and overshot plugs. Futhermore, use can cause the cases to expand and frequent resizing may be necessary.

It is therefore desirable to improve shot-shells and their components and to make it readily possible to reload them easily and for a considerable number of times.

According to the invention, there is provided a shotshell comprising a cartridge case having a base containing an opening for receiving a primer and a metal sidewall extending away from the base and defining an open end of the case at the opposite end to the base; a charge comprising propellant and gunshot contained in the cartridge case; and a plug closing off the open end of the case, the plug being at least a friction fit within the cartridge case.

The base and sidewall may be integral with one another and the whole case may be formed from brass by a deep drawing operation. In order to provide the sidewall with adequate strength, it may have a thickness of not less than about 0.5 mm, preferably about 1 mm, over at least substantially the whole of its length. It may also be of substantially uniform outside diameter along substantially the whole of its length.

A suitably made shot-shell of this nature can be recharged repetitively for a considerable period and, because of the thick wall, re-sizing of the sidewall and impact damage to the sidewall can be avoided or minimised. Cartridge cases with paper or plastics sidewalls cannot be used for the same period of time and are more prone to damage and to the need for re-sizing.

The plug, which may be of a plastics material, may be cup-shaped to reduce its weight and material content and may have its open end facing outwardly. It may have a length of at least about one-half its diameter to prevent it from twisting in the case about an axis perpendicular to the axis of the case.

The plug may have an annular groove in which there is an outwardly extending annular tongue biassed towards a position in which it protrudes from the groove. This tongue may engage a suitable formation provided in the cartridge case to secure the plug in place. The groove may contain a lubricant.

The gunshot may be contained in a cup-shaped cage. The cage may be slit over substantially its entire axial length to form a plurality of cage segments. The cage segments may be interconnected at the bottom of the cage by thin interconnecting portions. The cage may also be of a plastics material.

The cartridge may include a further plug, herein referred to as the lower plug, interposed between the propellant and the gunshot-containing cage. The lower plug may be substantially identical to the plug closing the cartridge case, but optionally having an air bleed hole therethrough. Furthermore, a shock absorbent wad of foamed plastics material may be interposed between the lower plug and the gunshot containing cage.

The cartridge case may be substantially of all brass construction, and may be provided with an extractor groove.

The invention also provides a cartridge case for use in the shot-shell of the invention, the cartridge case being of metal and having an opening for a primer at one end and a sidewall defining an open opposite end, the sidewall having a thickness of not less than about 0.5 mm over at least substantially the whole of its length.

The invention extends to a shotshell kit comprising a cartridge case open at one end and having a metal sidewall with a thickness of not less than about 0.5 mm over at least substantially the whole of its length, and a plug being a friction fit in the cartridge case and being adapted to close off the open end of the cartridge case when charged.

The kit may include a pair of such plugs and may further include a filler wad of foamed plastics material and/or a gunshot cage. The plugs may each have an air bleed hole closed by a removable or displaceable means for enabling the hole to be extended to pass completed through the plug.

The plug for use in closing off the end of the cartridge case of the kit may have a substantially cylindrical outer surface for frictionly engaging the internal wall of the cartridge case, an annular groove in the cylindrical surface, and an outwardly extending tongue protruding from the groove. Alternatively, the plug may have a plurality of grooves in its outer surface, the grooves separating ribs which can selectively engage a rim on the inner surface of the case.

The invention will now be described in more detail, by way of example, with reference to the accompanying drawings.

Figure 1:
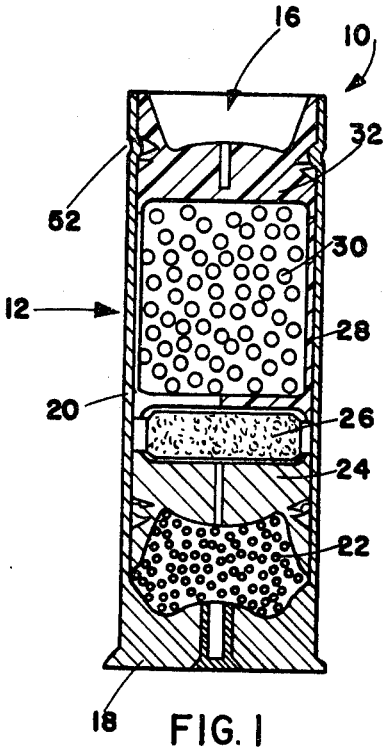
FIG. 1 shows a part cross-sectional side view of a loaded shotshell in accordance with the invention.
Figure 2:
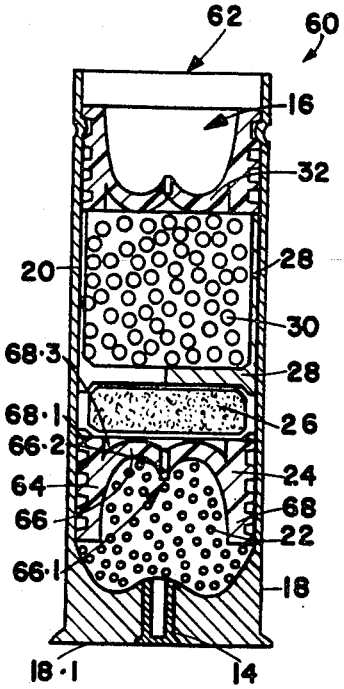
FIG. 2 shows a cross-sectional side view of a further shotshell.
Figure 6:
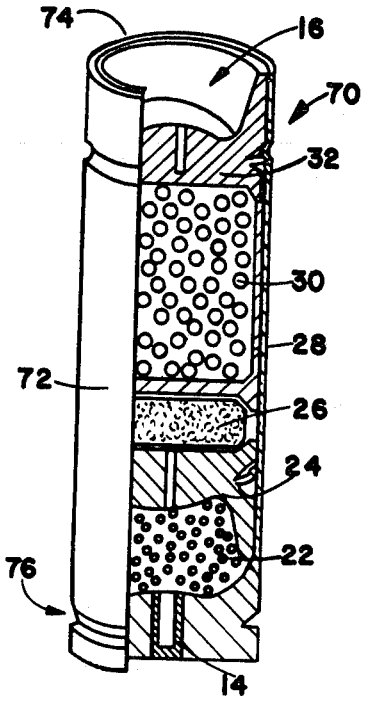

FIGS. 5*a* and 5*b* show enlarged cross-sectional side views of partially concave plugs forming parts of the shotshells of FIGS. 1, 2 and 6; and FIG. 6 shows a shotshell according to another embodiment of the invention.

Unless otherwise indicated, the same reference numerals indicate the same parts throughout the drawings.

Referring now to FIG. 1, reference numeral 10 generally indicates a shotshell having a brass cartridge case 12, a primer 14, and a charge 16 contained in the cartridge case.

The cartridge case 12 has a base 18 and a round cylindrical side 20 with a thickness of about 1 mm. The base 18 has an outwardly protruding locating rim 18.1. The primer 14 is a press fit in the base 18.

The charge 16 comprises, in sequence from the bottom or base end of the shotshell, a charge of powder propellant 22, a lower plug 24, a shock absorbent wad 26 of foamed plastics material, such as foamed polystyrene, a cup-shaped gunshot cage 28, a charge of gunshot 30 held in the cage, and an upper plug 32. The lower and upper plugs 24 and 32 are substantially identical, but face in opposite directions. In addition, the plug 24 has a central air bleed hole 24.1 to allow air to escape as the plug is inserted into the case.

Referring now more particularly to FIG. 5*a*, the plug 24, 32 is of moulded plastics construction and is generally cup-shaped having a body portion 34, a cylindrical side wall 36 extending in one direction, and an annular rim 38 extending in the opposite direction. The side wall 36 and rim 38 together define a round cylindrical outer surface, the dimensions of which are such that the plug is a friction fit in the cartridge case 12. The axial length of the plug is larger than half its diameter but smaller than its diameter.

At the level of the body portion 34, the plug 24, 32 has an annular, V-shaped groove divided in two parts 40.1 and 40.2 by an annular tongue 42. The tongue 42 protrudes slightly from the groove and the parts 40.1 and 40.2 are filled with a semi-solid lubricant 44.

The air bleed hole 24.1 in FIG. 5 is only partly formed, being blocked by part of the body 24.2. This part of the body can be poked out when the plug is to be used as a lower plug but retained for the upper plug.

Figure 3:
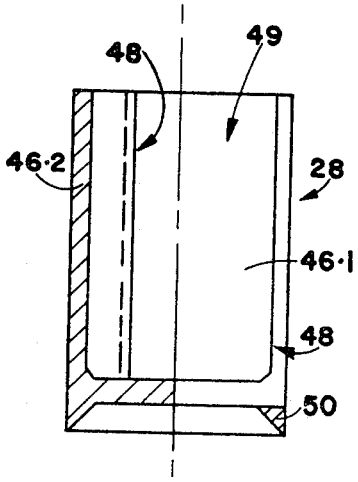
FIG. 3 shows a cross-sectional side view taken on line III—III in FIG. 4 of a gunshot cage forming part of the shotshells of FIGS. 1 and 2.
Figure 4:
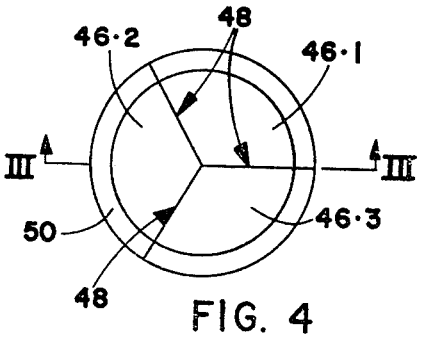
FIG. 4 shows an underneath plan view of the cage of FIG. 3.

Referring now more particularly to FIGS. 3 and 4, the gunshot cage 28, which is also of moulded plastics construction, has three segments 46.1, 46.2, and 46.3 separated by slits 48 and together defining a cavity 49 in which the charge 30 (FIG. 1) of gunshot is receivable. The three segments 46.1, 46.2, 46.3 are held together only by a ring 50 at the base of the cage, the ring being integral with the segments.

In loading the cartridge case 12, the primer 14 is first pressed home into the base 18 and the parts 22 through to 32 then inserted into the cartridge case in the sequence illustrated. Where a spent cartridge is to be reloaded, the spent primer is pressed out first and then replaced with a live primer. When the plugs 24 and 32 are inserted into the cartridge case 12, the tongues 42 are deflected by the side 20, thereby expelling the lubricant from the parts 40.1 or 40.2 of the groove, depending on the direction in which the plug is inserted. In the case of the upper plug 32, this expelled lubricant ensures that the cartridge is sealed against the ingress of moisture.

To provide for positive location of the upper plug 32, the side 20 of the cartridge case may have an inwardly protruding rim 52 behind which the tongue 42 can engage as shown in FIG. 5 at the righthand side of the drawing. A groove in the inner surface of the side 20 can be used in place of the rim 52 for locating the plug 32.

When the cartridge is fired from a shotgun, the plugs 24 and 32 are shot out through the shotgun barrel together with the wad 26, the cage 28, and the gunshot 30. In moving out of the cartridge case 12 or through the barrel of the shotgun, the tongues 42 of the plugs 24 and 32 are deflected in the direction opposite to that in which they were deflected when inserted into the cartridge case, thus expelling the lubricant from the part 40.1 or 40.2 of the groove, as the case may be. This lubricant will lubricate the barrel of the shotgun.

The primary purpose of the cage 28 is to protect the gunshot 30 from being deformed by contact with the barrel wall as the shot moves through the barrel. In segmented cages known to the applicant, the cage segments are interconnected along their entire lengths by thin web portions. This tends to keep the pellets in a bundle, preventing proper spread, and thus provides a shot pattern which is too tight. The cage 28, because it is slit along substantially its entire length, flies open as soon as it leaves the barrel, thus allowing the pellets to spread and providing a good shot pattern.

Referring now to FIG. 2, there is shown a shotgun cartridge 60 having a standard length cartridge case 20 formed of deepdrawn brass and including a locating rim 18.1. It differs from the cartridge 10 in that it contains a shorter cage 28 and a correspondingly smaller charge of gunshot 30. The upper plug 32 is therefore pressed in deeper than with the cartridge 10 so as to leave an unoccupied space 62 in front of the plug 32. The case may be provided with more than one inner rim 52 to allow the plug 32 to be located at different levels in the case.

The plugs 24 and 32 are now in the form of plugs 64 as shown in FIG. 5*b*. The plugs 64 are of moulded plastics material and each have a central body portion 66 which merges with an annular side wall 68. Rims 68.1 form extensions of side walls 68. Each rim 68.1 extends alongside the respective body portion 66 but is spaced from the body portion around part of its circumference by cavities 68.2 between six equally spaced radial webs 68.3. The length of the plug is again such that it cannot twist about an axis transverse to the axis of the case once it has been inserted in the case.

The centre of each body 66 forms a funnellike formation 66.1 extending into the propellant 22. The lower plug has a central air bleed hole 66.2 for alowing air to escape from the case as the plug is inserted, whereas the upper plug has the bleed hole blocked by part of the body of the plug, as in the plug of FIG. 5*a*. Such a plug is shown in FIG. 5*b*. The inner wall of the plug, that is the wall bordering the propellant, is shaped to enhance combustion of the propellant in use.

The outer surface of the wall 68 and rim 68.1 of each plug comprises a plurality of annular ribs and grooves. The grooves can contain a lubricant, if desired, and the ribs are such that the plugs are each a friction fit in the case 20.

One of the ribs at the outer surface of the upper plug engages the rim 52 in the case to locate the plug in position. However, the rim 52 can be engaged by different ribs when different size charges are used. This can help secure the plug when the shell is in transit or is subjected to recoil.

Referring now to FIG. 6, reference numeral 70 generally indicates a shotgun cartridge having a cartridge case 72 of deep-drawn all brass construction. It has a sidewall 18 with a thickness of about 1 mm. Its charge 16 is the same as that shown in FIG. 1. The cartridge 70 is intended for use with a modified shotgun having a cartridge chamber in which the cartridge can be located by having its front edge 74 seating against a shoulder in the chamber wall. Thus, it does not need an extractor rim 18.1 as with the cartridges shown in FIGS. 1 and 2, but may have an extractor groove 76 as with conventional rifle cartridges. Thus, a shotgun may be provided with an automatic or semi-automatic rifles.

The cartridge case 72 will have an almost indefinite re-use life as compared with the re-use life of plastics or paper cartridge cases. Furthermore, the provision of lubricant in the grooves in the plugs can help to seal the shell while lubricating the barrel of a shotgun each time that the gun is fired. This is particularly important when steel shot is used.

For refilling the cases, suitable kits may be sold. These kits may, for example, comprise sets of at least one plug 24, at least one plug 32, a wad 26 and a shot cage 28. The plugs may be of either of the types previously described. Several such sets may be packaged together in each kit and each set may be individually packaged within the set. Each kit may also incorporate a suitable amount of shot for the number of sets provided in the kit. The wads 26 may be supplied in the form of an elongate element of polystyrene foam or like material. This element may be marked, for example by annular grooves, at suitable intervals along its length to show where the element is to be cut to from the wads.

I claim:

1. A shot-shell comprising a cartridge case having a base containing an opening for receiving a primer and a metal sidewall extending away from the base and defining an open end of the case at the opposite end to the base, said sidewall having a thickness of not less than about 0.5 mm over at least substantially the whole of its length; a charge comprising propellant and gunshot contained in the cartridge case; and an upper plug closing off the open end of the case; and a lower plug interposed between the propellant and the gunshot, the lower plug being of substantially identical construction to the plug closing the cartridge case; said plugs each being at least a friction fit within the cartridge case and each being cup-shaped to reduce its weight and material content, said plugs each having a length of at least about one-half its diameter and frictionally engaging said sidewall at locations along its length to prevent it from twisting in the case about an axis perpendicular to the sidewall of the case, said upper plug retaining at least the gunshot in said cartridge case.

2. A shotshell according to claim 1, wherein the base and sidewall are integral with one another and the whole case is formed from brass by a deep drawing operation.

3. A shotshell according to claim 1 wherein the sidewall has a thickness of not less than about 1 mm over at least substantially the whole of its length.

4. A shotshell according to claim 3, wherein the sidewall has a substantially uniform outside diameter along substantially the whole of its length.

5. A shotshell according to claim 3, wherein the sidewall is provided with a radially inwardly projecting formation for engagement by a formation on the plug to locate the plug in position.

6. A shotshell according to claim 1 wherein the plug has an outer surface containing a plurality of grooves separated by rib formations engaging the sidewall.

7. A shotshell according to claim 6, wherein a lubricant is contained in at least one groove in the plug.

8. A shotshell according to claim 1, wherein the gunshot is contained in a cup-shaped cage, the cage being slit over substantially its entire axial length to form a plurality of cage segments interconnected at the bottom of the cage by relatively thin interconnecting portions.

9. A shotshell according to claim 8, wherein said lower plug is interposed between the propellant and the gunshot-containing cage, the lower plug being substantially identical to the plug closing the cartridge case, but having an air bleed hole therethrough.

10. A shotshell according to claim 9, wherein a shock absorbent wad of foamed plastics material is interposed between the lower plug and the gunshot containing cage.

11. A shotshell comprising:

a cartridge case having a base containing an opening for receiving a primer and a metal sidewall extending away from the base and defining an open end of the case at the opposite end to the base, the sidewall having a thickness of not less than about 0.5 mm over at least substantially the whole of its length and having an essentially groove-free inner wall;

a primer in the opening in said base;

a propellant in said case adjacent to the primer to be ignited by the primer;

a cup-shaped overpowder plug pressed down into the case to trap the propellant adjacent to the primer;

a shot cage received in the case on the opposite side of the overpowder plug to the propellant and defining a shot receiving space facing away from the overpowder plug;

shot received in the cage to be propelled from the cage by the propellant; and an overshot plug of substantially identical construction to said overpowder plug pressed into and closing off the open end of the case, said overshot plug trapping at least the shot in the case;

said overpowder plug and overshot plug each having a diameter whereby they are each at least a press friction fit in the case against said groove-free inner wall and each having a length of at least about one-half of its diameter to prevent it twisting in the case.

* * * * *